US009972909B2

(12) United States Patent
Sato

(10) Patent No.: US 9,972,909 B2
(45) Date of Patent: May 15, 2018

(54) THREE-AXIS ANTENNA

(71) Applicant: TOKO, INC., Tsurugashima-shi, Saitama-ken (JP)

(72) Inventor: Kachiyasu Sato, Tsurugashima (JP)

(73) Assignee: Murata Manufacturing Co., Ltd., Nagaokakyo-shi, Kyoto (JP)

( * ) Notice: Subject to any disclaimer, the term of this patent is extended or adjusted under 35 U.S.C. 154(b) by 69 days.

(21) Appl. No.: 14/710,630

(22) Filed: May 13, 2015

(65) Prior Publication Data

US 2015/0333405 A1 Nov. 19, 2015

(30) Foreign Application Priority Data

May 13, 2014 (JP) ..... 2014-099298
Mar. 20, 2015 (JP) ..... 2015-057361

(51) Int. Cl.

| | |
|---|---|
| ***H01Q 7/06*** | (2006.01) |
| ***H01Q 7/00*** | (2006.01) |
| ***H01Q 21/06*** | (2006.01) |
| ***H01Q 1/32*** | (2006.01) |
| ***H01Q 7/08*** | (2006.01) |
| ***H01Q 21/24*** | (2006.01) |

(52) U.S. Cl.

CPC ..... *H01Q 7/00* (2013.01); *H01Q 1/3241* (2013.01); *H01Q 7/06* (2013.01); *H01Q 7/08* (2013.01); *H01Q 21/06* (2013.01); *H01Q 21/24* (2013.01)

(58) Field of Classification Search

CPC ..... H01Q 7/00; H01Q 1/3241; H01Q 7/06; H01Q 7/08; H01Q 21/06

See application file for complete search history.

(56) References Cited

U.S. PATENT DOCUMENTS

| | | | | |
|---|---|---|---|---|
| 6,644,555 | B1 | 11/2003 | Berney | |
| 2003/0222829 | A1 | 12/2003 | Kitahara et al. | |
| 2007/0091009 | A1 | 4/2007 | Lueg-Althoff et al. | |
| 2007/0195001 | A1 * | 8/2007 | Ueda ..... | H01Q 21/24 343/788 |

(Continued)

FOREIGN PATENT DOCUMENTS

| | | | |
|---|---|---|---|
| CN | 201126858 | Y | 10/2008 |
| CN | 102377026 | A | 3/2012 |

(Continued)

OTHER PUBLICATIONS

European Search Report (Application No. 15167093.2) (6 pages—dated Sep. 16, 2015).

(Continued)

*Primary Examiner* — Jessica Han
*Assistant Examiner* — Bamidele A Jegede
(74) *Attorney, Agent, or Firm* — Renner, Kenner, Greive, Bobak, Taylor & Weber

(57) ABSTRACT

A three-axis antenna including a first through a third antenna coils each of which has: a planar coil wound around a winding axis, and sheet cores inserted into the central hole of each the planar coils, wherein the three antenna coils are arranged in a manner that the respective antenna coils do not overlap each other, and the planes of the planar coils are coplanar, and the axial directions of the respective sheet cores of the first through third antenna coils cross and, in doing so, form angles of 120° with each other.

5 Claims, 20 Drawing Sheets

(56) References Cited

U.S. PATENT DOCUMENTS

| | | | | |
|---|---|---|---|---|
| 2008/0074270 | A1 | 3/2008 | Ashwood-Smith et al. | |
| 2010/0022836 | A1 | 1/2010 | Colliou et al. | |
| 2010/0289496 | A1* | 11/2010 | Cole | E21B 47/02224 324/343 |
| 2012/0038443 | A1* | 2/2012 | Kubo | G06K 7/10336 336/90 |
| 2012/0062358 | A1* | 3/2012 | Nowottnick | G06K 19/07767 340/5.2 |
| 2013/0038498 | A1* | 2/2013 | Ferrer-Herrera | H01Q 1/007 343/788 |

FOREIGN PATENT DOCUMENTS

| | | | |
|---|---|---|---|
| CN | 104821436 | A | 8/2015 |
| DE | 10 2012 001 899 | A1 | 8/2013 |
| GB | 2469209 | A | 6/2010 |
| JP | 2006-217265 | A | 8/2006 |
| JP | 2006-311021 | | 11/2006 |
| JP | 2010-245776 | A | 10/2010 |

OTHER PUBLICATIONS

Japanese Office Action with English Translation (JP Application No. 2015-057361) (5 pages—dated Apr. 11, 2017).
Chinese Office Action with English Translation (CN Application No. 201510242731.1) (14 pages—dated Nov. 27, 2017).

* cited by examiner

THREE-AXIS ANTENNA

CROSS-REFERENCE TO RELATED APPLICATIONS

This application is based upon and claims the benefit of priority from the prior Japanese Patent Application No. 2014-099298, filed on May 13, 2014, and the prior Japanese Patent Application No. 2015-057361, filed on Mar. 20, 2015, the entire contents of which are incorporated herein by reference.

BACKGROUND OF THE INVENTION

Field of the Invention

The present invention relates to an omni-directional reception sensitivity three-axis antenna which is used in a receiving device of a keyless entry system for locking or unlocking a vehicle, etc.

Description of the Related Art

As an antenna for LF band, a bar antenna which consists of wire wound around a bar-type core winding axis is used. Such a bar antenna has a reception sensitivity in the direction of the winding axis and does not have that in directions orthogonal to the winding axis. Therefore, as plural antenna coils mutually compensate for their respective area which lacks reception sensitivity by arranging three antenna coils such that the respective winding axes orthogonally cross each other, an antenna having omni-directional reception sensitivity is obtained.

In recent years, a small-sized three-axis antenna, having three coils wound orthogonally to each other around a single core, as shown in Japanese patent laid-open No. 2004-15168, is used widely.

FIG. 20 shows an example of a prior art three-axis antenna. As shown in FIG. 20, a conventional three-axis antenna 70 is configured by a core 80 consisting of an externally flat disk-type ferrite core 80, on which circumference surface, mutually orthogonally crossing on the top and bottom surfaces of the core 80, an x groove 81, a y groove 82 and a z groove 83 are provided, with an x axis coil 91, a y axis coil 92 and a z axis coil 93 respectively wound around the x groove 81, the y groove 82 and the z groove 83.

The three-axis antenna 70 has omni-directional reception sensitivity due to the winding axes of the x axis coil 91, the y axis coil 92 and the z axis coil 93 being orthogonal to each other.

SUMMARY OF THE INVENTION

Problem to be Solved by the Invention

Although the above-mentioned prior art three-axis antenna is low-profiled, its thickness still exceeds 3 mm. Thus, it may be incorporated in a key holder or the like, but not in a thin article like an IC card standardized at 85.6 mm width, 54.0 mm height and 0.76 mm thickness.

Means for Solving the Problem

The present invention is characterized by the provision of:

A three-axis antenna comprising a first through a third antenna coils each of which comprises: a planar coil wound around a winding axis circumferentially to make a central hole, and a sheet core inserted into the central hole, wherein a first through a third antenna coils are arranged in a manner that the respective antenna coils do not overlap each other, and the planes of the planar coils make one plane, and the axes of the respective sheet cores of the first through third antenna coils cross each other at angle of 120° each.

Effect of the Invention

According to the three-axis antenna of the present invention, a three-axis antenna which can be incorporated in a thin article like an IC card, etc. may be obtained.

DETAILED DESCRIPTION OF THE INVENTION

First Embodiment

Figure 1:
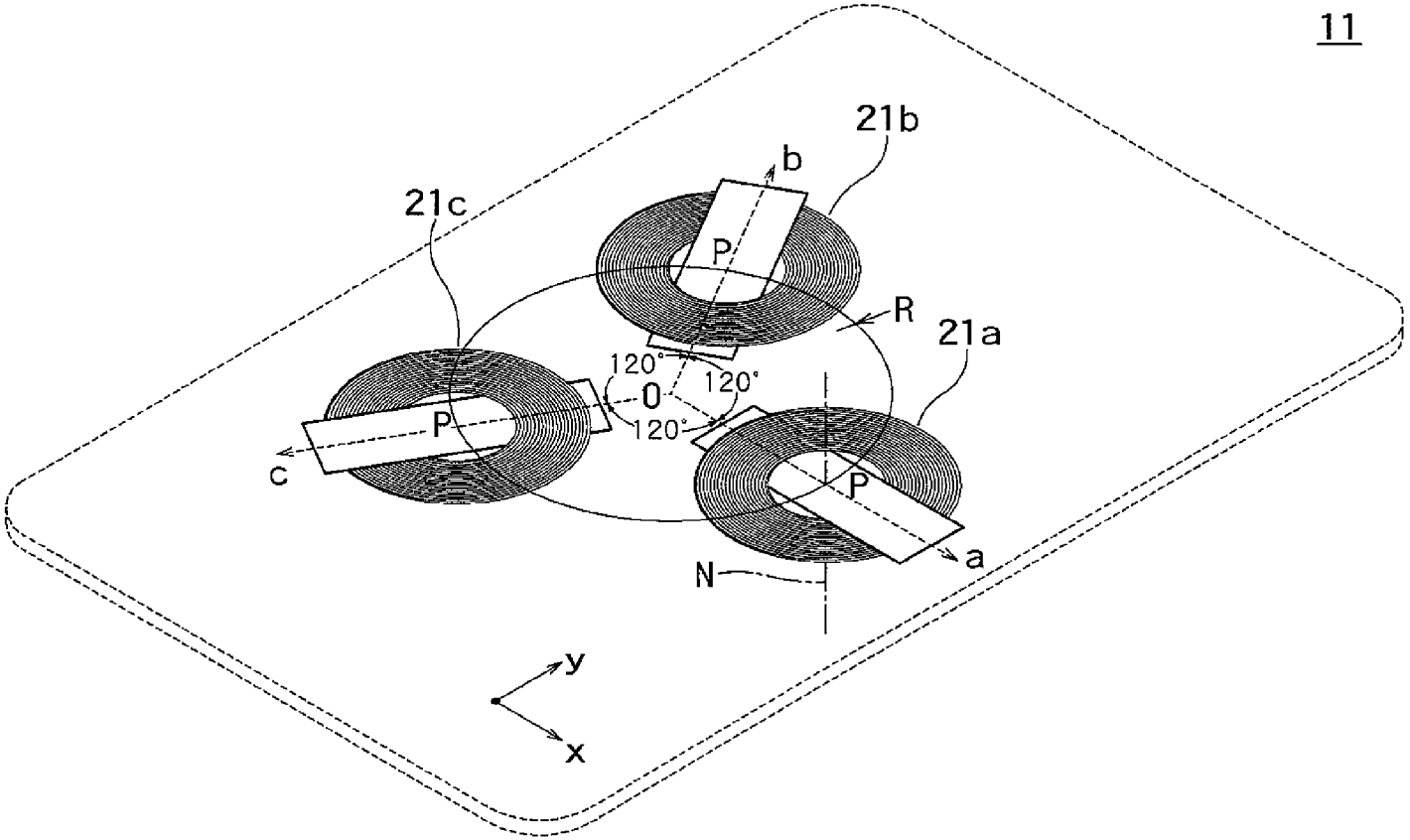
FIG. 1 is a perspective view of the first embodiment of the three-axis antenna of the present invention.
Figure 2A:
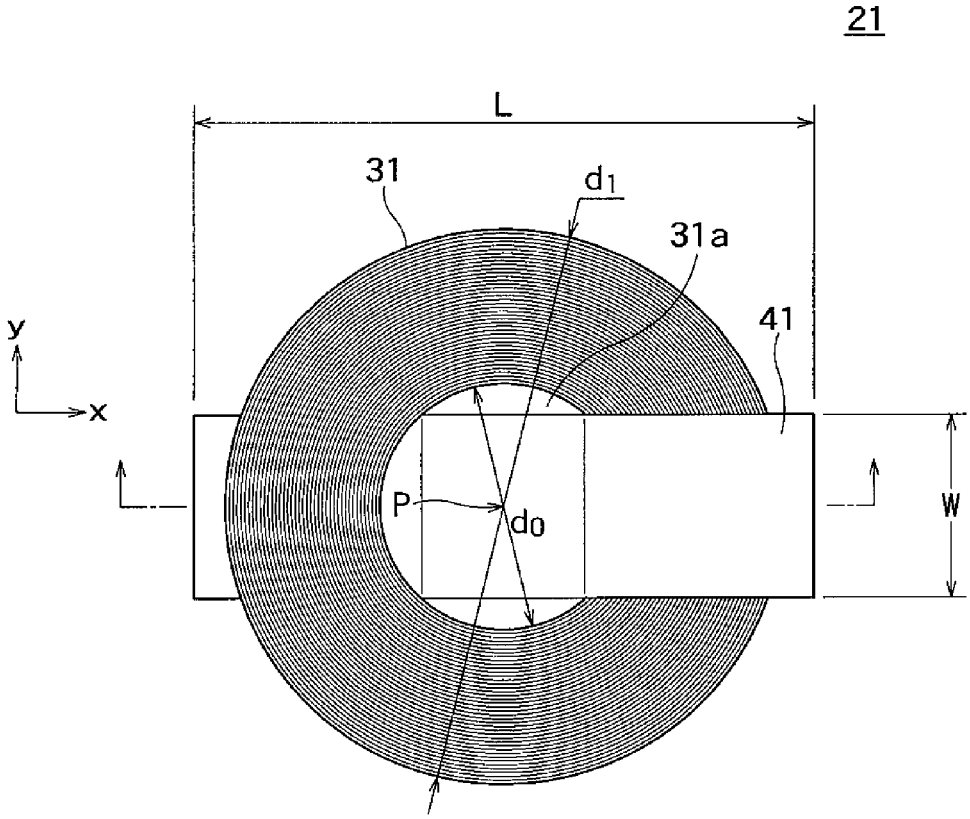
FIG. 2A is a plan view of an antenna coil in the embodiment.
Figure 2B:
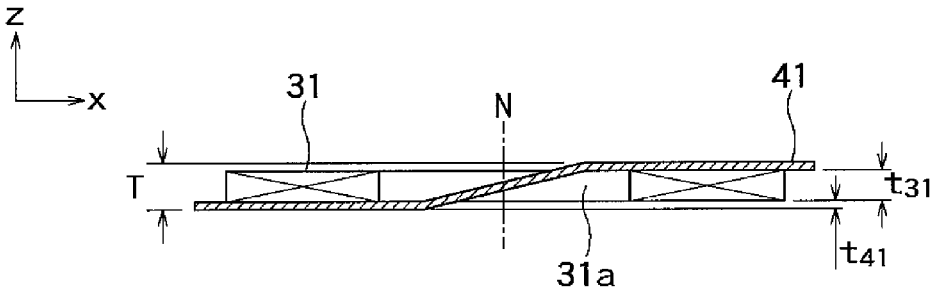
FIG. 2B is a longitudinal sectional view of the antenna coil.

FIG. 1 is a plan view of an embodiment of a three-axis antenna according to the present invention. FIGS. 2A and 2B are a plan view and a sectional view thereof, for showing an antenna coil employed in the three-axis antenna.

As shown in FIG. 1, the three-axis antenna 11 contains an antenna coil 21 having three planar antenna coils 21*a*, 21*b* and 21*c* arranged on the x-y plane.

The antenna coil 21 having the antenna coils 21*a*, 21*b* and 21*c* which include, as shown in FIGS. 2A (plan view) and 2B (sectional view), a flat-shaped planar coil 31 of an inner diameter $d_0$, an outer diameter $d_1$ and a thickness $t_{31}$ formed of insulated wire wound around a winding axis N, and a rectangular sheet shaped sheet core 41 of a length L, a width W, a thickness $t_{41}$, inserted into the central hole 31*a* of the planar coil 31. The planar coil 31 is wound around a winding axis N to make the central hole 31*a* at the center, and the sheet core 41 is inserted into the central hole 31*a*.

The sheet core 41 is a rectangular foil-type core, which is configured by forming a thin film of soft magnetic material on a sheet-like PET base material, and is inclined at about 90° to the winding axis N of the planar coil 31. The sheet core 41 and the planar coil 31 are overlapped each other so that the lower surface at one end of the sheet core contacts the upper surface of the planar coil 31, and the upper surface at the other end of the sheet core 41 contacts the lower surface of the planar coil 31.

Designating the respective centers of the antenna coils 21*a*, 21*b* and 21*c* as P and the axial directions of the sheet cores 41 (FIG. 2A) and 43 (FIG. 9) as a axis, b axis and c axis (refer to FIG. 1), the three-axis antenna 11 is arranged to cross the a axis, the b axis and the c axis at the point of origin 0, and the centers P are positioned on the circle of radius R and with the center in the point of origin 0 so that the axes a, b and c make an angle of 120° with each other.

Hereunder, the omni-directionality of the three-axis antenna 11 and the conditions thereof will be explained.

Figure 3:
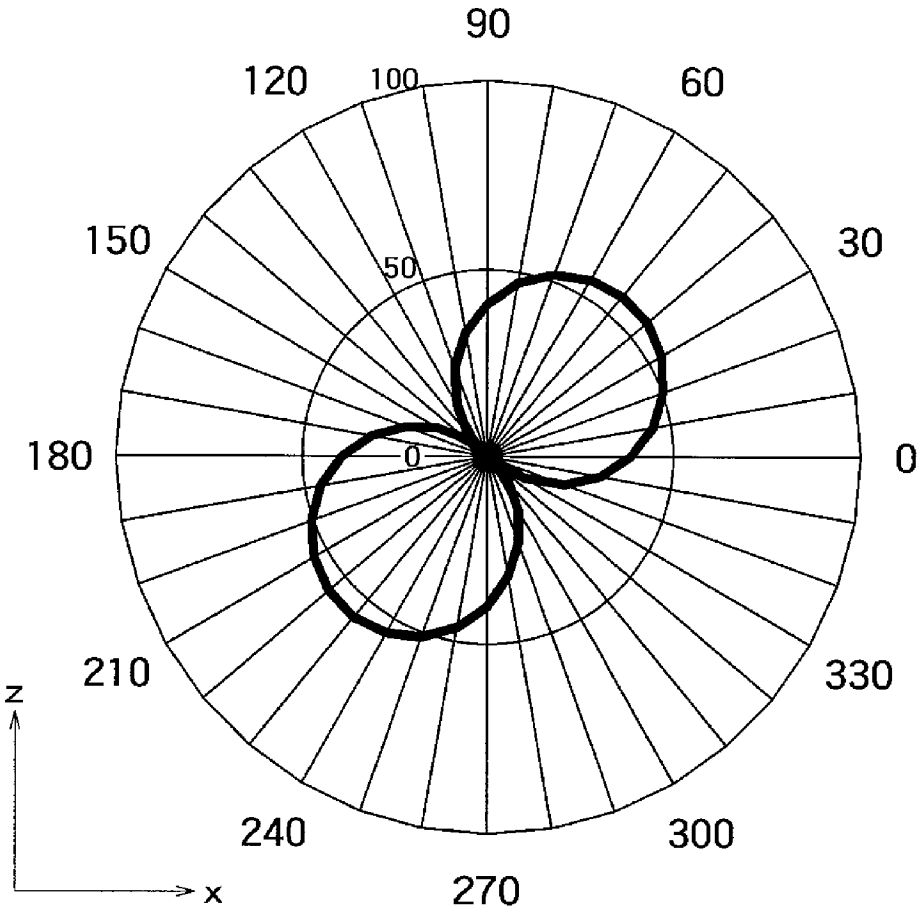
FIG. 3 is a graph showing the radiation characteristics of the antenna coil.

FIG. 3 is a graph showing the radiation characteristics of the antenna coils 21. In FIG. 3, the axial direction of the sheet core 41 is designated as the x direction and the winding direction of the planar coil 31 is designated as z axis.

Here, the planar coil 31 is constructed by winding, for 332 turns, self-fusion wire of 0.045 mm diameter, with an inner diameter $d_0$=8 mm, an outer diameter $d_1$=19 mm, a thickness $t_{31}$=0.2 mm, and the sheet core 41 has a relative permeability $\mu_r=10^4$, a length L=20 mm, a width W=6 mm and a thickness $t_{41}$=0.060 mm.

Figure 4:
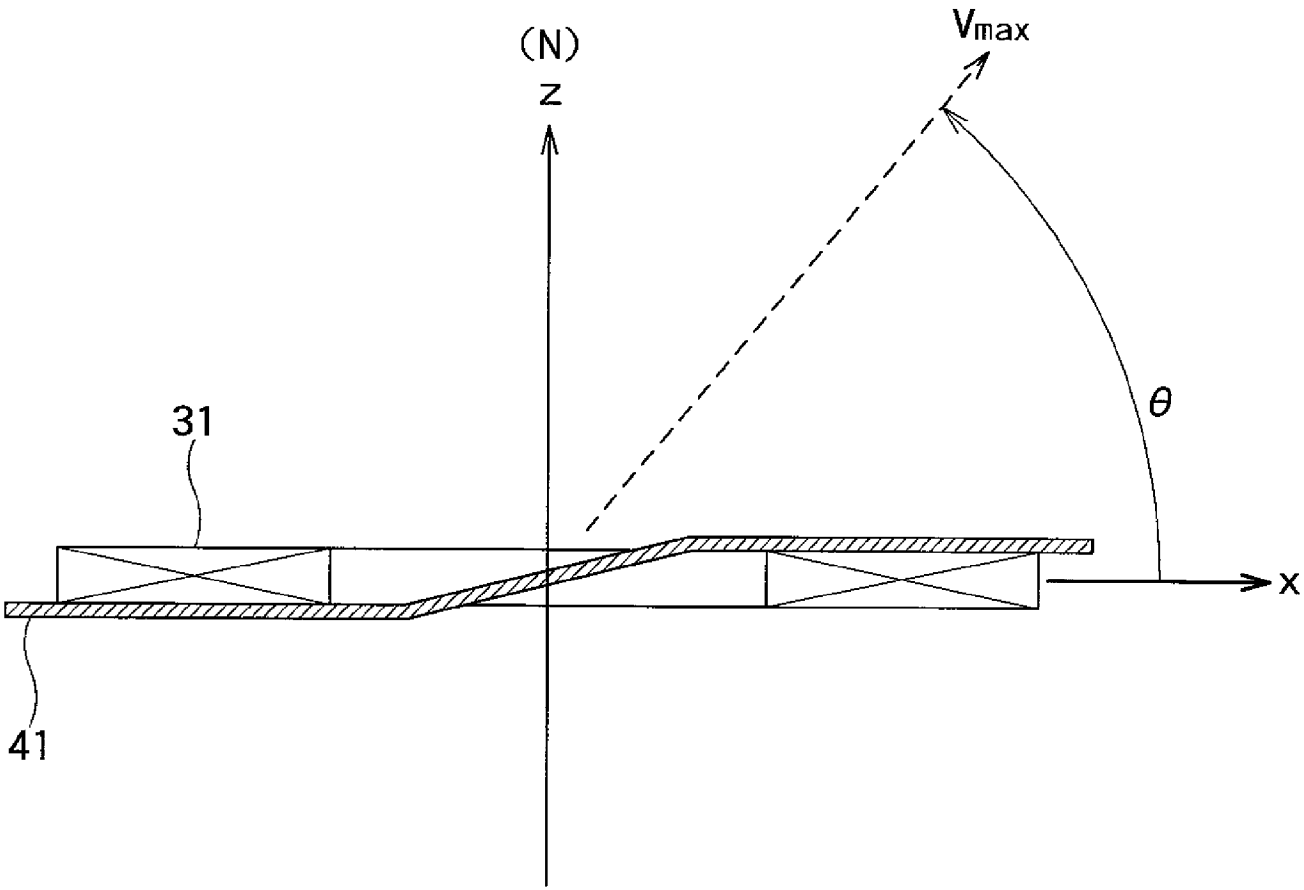
FIG. 4 is a sectional view showing the radiation characteristics of the antenna coil.

Conventional bar-type antennas wound around a bar-type core have maximum reception sensitivity and generate maximum induced voltage in the axial direction. On the contrary, in the antenna coils 21 shown in FIG. 1, the direction of the maximum reception sensitivity, namely, the direction generating the maximum induced voltage $V_{max}$ forms an inclination angle θ ($0° \leq \theta \leq 90°$) to the axial direction (x axis) of the sheet core 41, as shown in FIG. 4. The angle θ in FIG. 4 is about 50°.

Here, the reception sensitivity is defined as the induced voltage generated in an antenna coil when the antenna coil is located in the magnetic field of 1 μT.

The inclination angle θ, together with the maximum induced voltage $V_{max}$, can be adjusted by varying the shape of the sheet core 41, the relative permeability $\mu_r$, etc. Namely, the inclined angle θ will be smaller if the length L of the axial direction of the sheet core 41 is longer, the sectional area $W \times t_{41}$ is larger or the relative permeability $\mu_r$ is increased.

Figure 5:
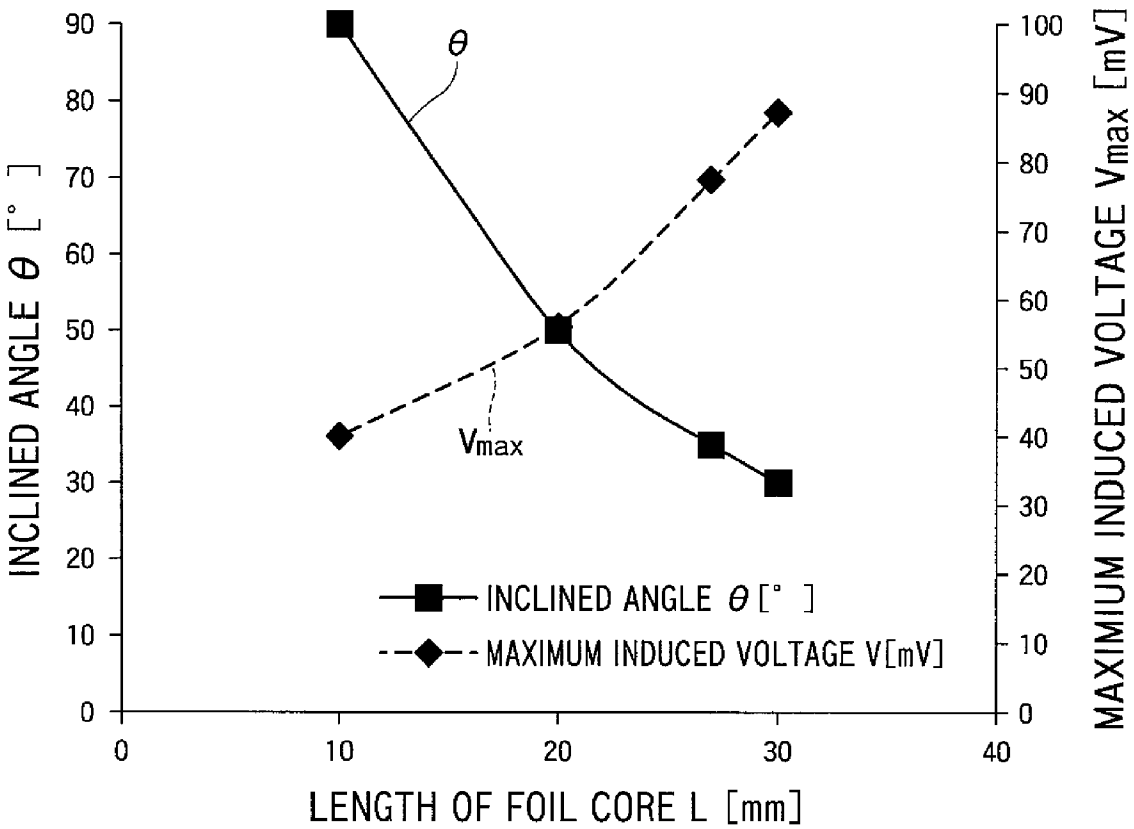
FIG. 5 is a graph showing the characteristics of the antenna coil.

FIG. 5 is a graph showing the variations of the inclination angle θ and the maximum induced voltage $V_{max}$ when the axial direction length L of the sheet core 41 is modified. In FIG. 5, the abscissa represents the longitudinal length L [mm] of the sheet core, and the ordinate represents the inclination angle θ [°] and the maximum induced voltage $V_{max}$ [V], wherein the solid line represents the inclination angle θ and the dotted line represents the maximum induced voltage $V_{max}$. The planar coil employed herein is the same as the planar coil 31 explained in FIGS. 2A and 2B.

It is understood from FIG. 5 that the longer the longitudinal length L of the sheet core 41 is, the smaller the inclination angle θ and the larger the maximum induced voltage $V_{max}$ are.

Figure 6:
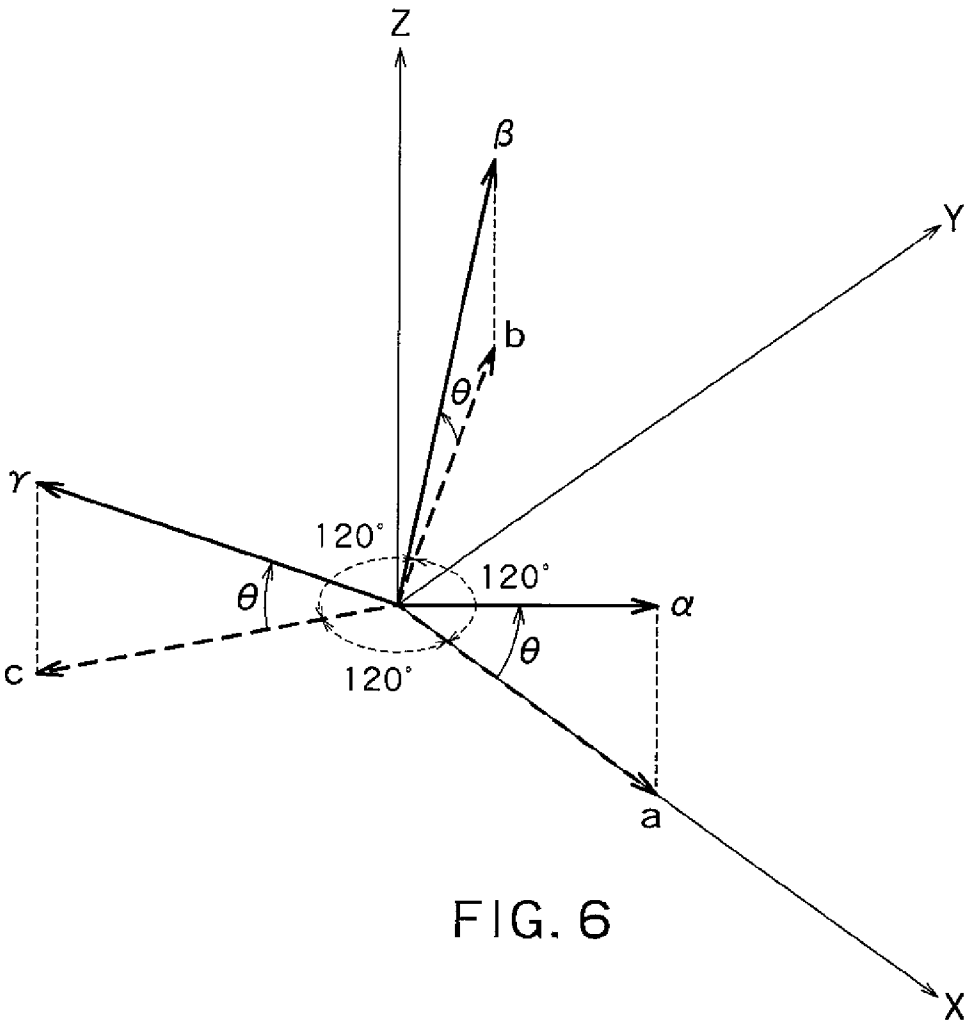
FIG. 6 is a characteristics diagram showing the direction of the maximum reception sensitivity of the three-axis antenna according to the present invention.

FIG. 6 is a characteristics diagram showing the directions of the maximum reception sensitivity of the antenna coils 21*a*, 21*b* and 21*c* (not shown) together with the reception sensitivity of the three-axis antenna 11. In FIG. 6, supposing the longitudinal direction of the sheet core of the antenna coil 21*a* is the a axis, the direction of the maximum reception sensitivity is the α axis, and the inclination angle is θ, supposing the axial direction of the sheet core of the antenna coil 21*b* is the b axis, the direction of the maximum reception sensitivity is the β axis, and the inclination angle is θ, supposing the axial direction of the sheet core of the antenna coil 21*c* is the c axis, the direction of the maximum reception sensitivity is the γ axis, and the inclination angle is θ, and supposing the a axis is the x axis, the angles between the a axis, the b axis and the c axis are 120°, respectively, and the axes cross each other at the point of origin 0.

As shown in FIG. 6, since the α axis, the β axis and the γ axis need to cross orthogonally each other in order to render the three-axis antenna 11 omni-directional, is that the inclination angle θ is formed at 35.26°. From the graph of FIG. 5, the axial length L of the sheet core 41 for obtaining the inclination angle θ of 35.26° is about 27 mm.

Figure 7A:
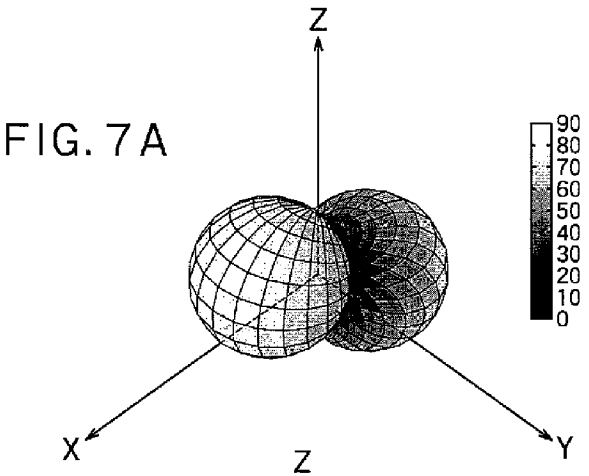
FIGS. 7A through 7D show simulations of the radiation characteristics of the three-axis antenna according to the present invention.
Figure 7B:
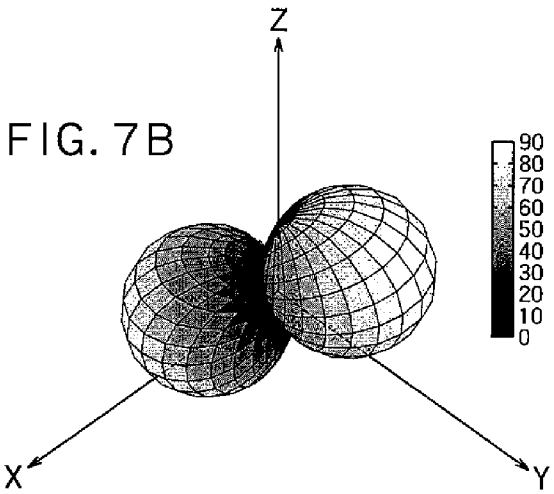
Figure 7C:
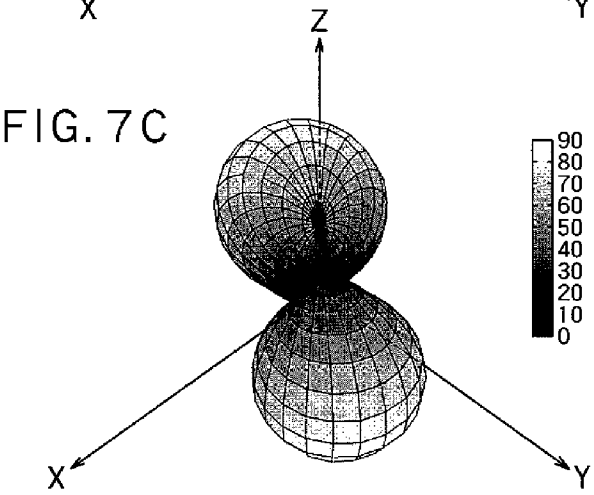
Figure 7D:
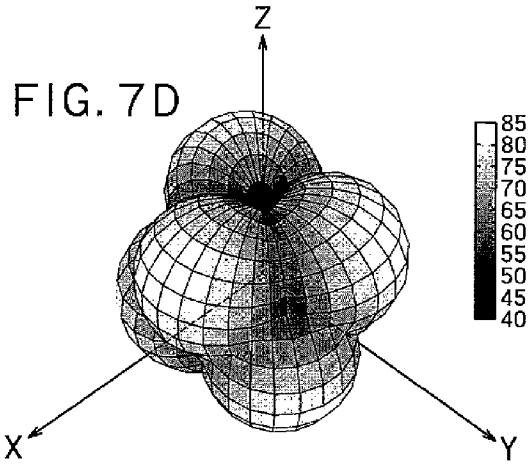

FIGS. 7A through 7D show radiation characteristics as results of simulations on the antenna coils 21*a*, 21*b* and 21*c* forming the inclined angle θ=35.26° which are used by the three-axis antenna 11, wherein FIG. 7A shows radiation characteristics of the antenna coil 21*a*, FIG. 7B shows radiation characteristics of the antenna coil 21*b*, FIG. 7C shows radiation characteristics of the antenna coil 21*c*, and FIG. 7D shows radiation characteristics of the three-axis antenna 11 as obtained by the logical sum of the radiation characteristics of the antenna coils 21*a*, 21*b* and 21*c*.

As shown in FIG. 7D, the three-axis antenna 11 is an antenna having omni-directional reception sensitivity.

The thickness T ($=t_{31}+t_{41}\times 2$, shown in FIG. 2B) of the abovementioned antenna coil is about 0.32 mm. This is thinner than the thickness of the base material, obtained by excluding the respective 0.20 mm thicknesses of the top and bottom surfaces of the exterior from the thickness 0.76 mm of an IC card, so that the three-axis antenna 11 can be embedded into an IC card.

In addition, such a three-axis antenna 11 that uses the sheet core and the thin planar coil is different from conventional three-axis antennas that use thick ferrite in that a certain flexibility is expected which recommends it for incorporation into an IC card, etc.

Besides, the inclined angle of 35.26° of is ideal in theory but the antenna coils have reception sensitivity even slightly away from the maximum reception sensitivity direction. Therefore, even if there are slight differences in the inclined angle θ and the arrangement of the antenna coils, the areas lacking reception sensitivity are mutually complementary ensuring that the antenna is omni-directional.

Second Embodiment

Figure 8:
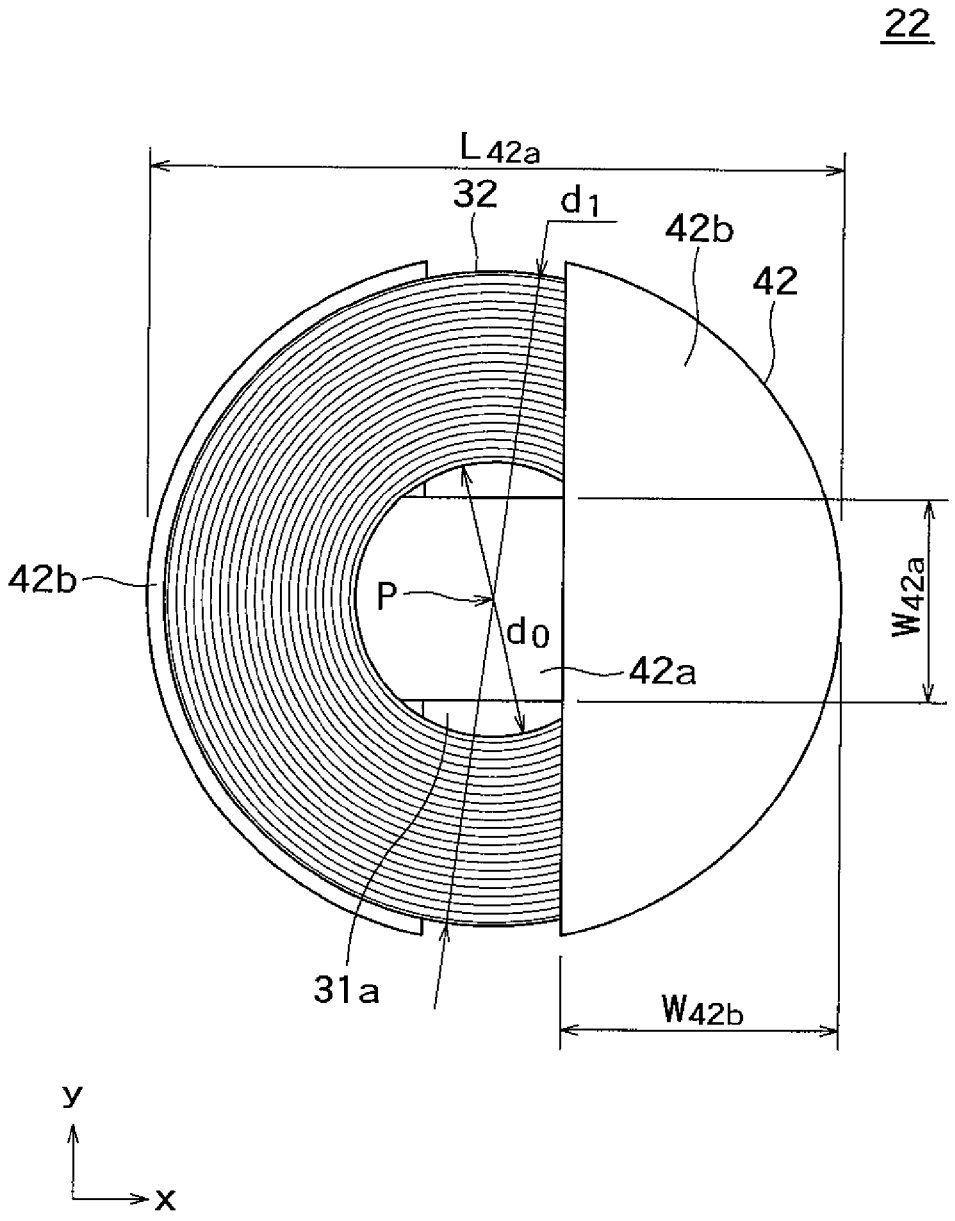
FIG. 8 is a plan view of the second embodiment of the present invention.

The shape of a sheet core is not limited to being rectangular. As shown in FIG. 8, a three-axis antenna coil can be an antenna coil having H-shaped planar profile sheet core which combines a plurality of sheet-like core pieces.

FIG. 8 is a plan view of an antenna coil which is employed in the second embodiment of the present invention. As shown in FIG. 8, an antenna coil 22 includes a planar coil 32, and an H-shaped sheet core 42 inserted into a central hole 31*a* of the planar coil 32. The sheet core 42 consists of a rectangular sheet core piece 42*a*, and two sheet-like core pieces 42*b*, 42*b*, of a semi-circular shape which are positioned at opposite ends of the core piece 42*a*. The planar coil 32 is the same as the planar coil 31 described in the first embodiment. The core piece 42*a* has a length $L_{42a}$, a width $W_{42a}$, and a thickness $t_{42}$, and the core piece 42*b* has a diameter $L_{42a}$, and a height of arc $W_{42b}$.

Since the sheet core 42's outline is made to fit that of the planar coil 32, the antenna coil 22 can be easily positioned without overlapping.

Third Embodiment

Figure 9:
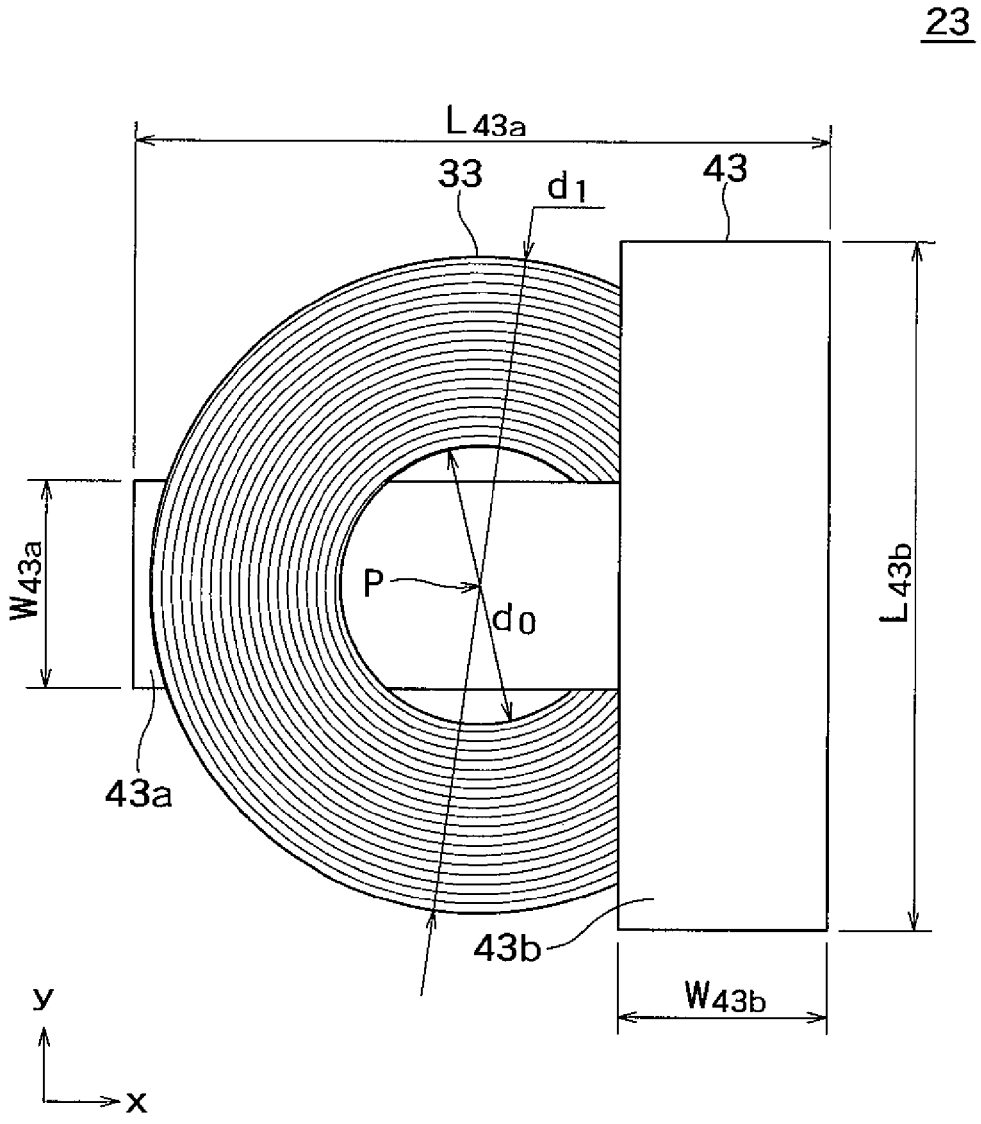
FIG. 9 is a plan view of the third embodiment of the present invention.

A three-axis antenna coil can use, as shown in FIG. 9, an antenna coil configured by combining a plurality of sheet-like core pieces to form a T-shaped sheet core.

FIG. 9 is a detailed plan view showing an antenna coil employed in the third embodiment of the present invention.

As shown in FIG. 9, an antenna coil 23 includes a planar coil 33, a sheet core 43 of a T-shaped planar profile which is inserted into the central hole of the planar coil 33, and the sheet core 43 includes a rectangular sheet core piece 43*a* and a rectangular sheet core piece 43*b* arranged at one end of the core piece 43*a*. The planar coil 33 is the same as the planar coil 31 in the first embodiment. The core piece 43*a* has a length $L_{43a}$, a width $W_{43a}$ and a thickness $t_{43}$, and the core piece 43*b* has a length $L_{43b}$, a width $W_{43b}$ and a thickness $t_{43}$. In relation to the axial direction of the sheet core 43 (x axis in FIG. 9), the antenna coil 23 is asymmetrical but the radiation characteristic is symmetrical.

As described in the first through third embodiments, a sheet core may have various shapes for attaining desired characteristics, and has many choices. Thus, a single sheet core may be employed or combined plural sheets may also be employed for ease of assembly.

Comparative Example

Figure 20:
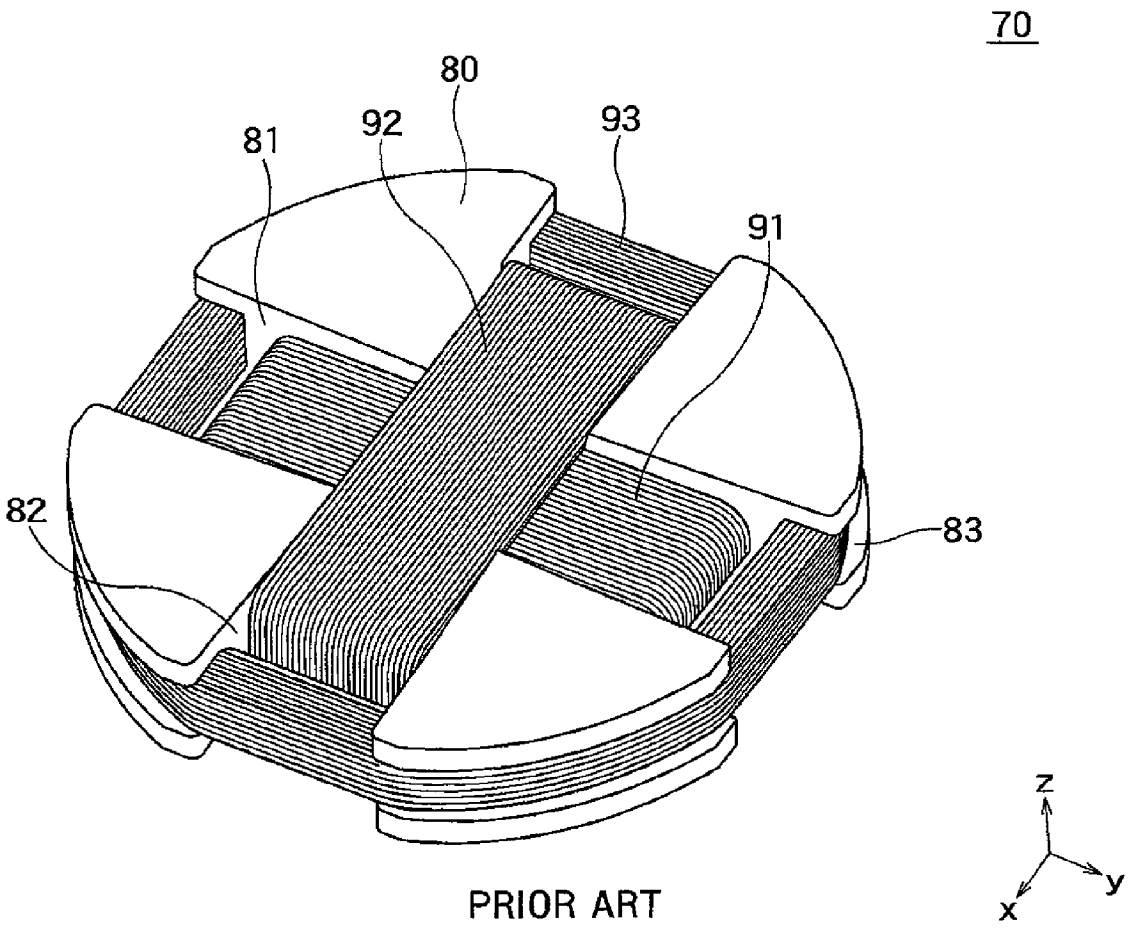
PRIOR ART FIG. 20
FIG. 20 is a perspective view of a conventional three-axis antenna.

In a conventional three-axis antenna in FIG. 20, no electro-magnetic coupling occurs among the three antenna coils. However, in a three-axis antenna which realizes omni-directional antenna by combining a plurality of bar antennas, electro-magnetic coupling will occur when antenna coils are arranged closely, and as a result, the reception sensitivity of an antenna will be affected.

Similarly, the reception sensitivity of the three-axis antenna according to the present invention is affected by electro-magnetic coupling among the antenna coils. The shorter the distances among the antenna coils are, the stronger the electro-magnetic coupling is. Therefore, the miniaturization of a three-axis antenna is rather difficult.

Figure 10:
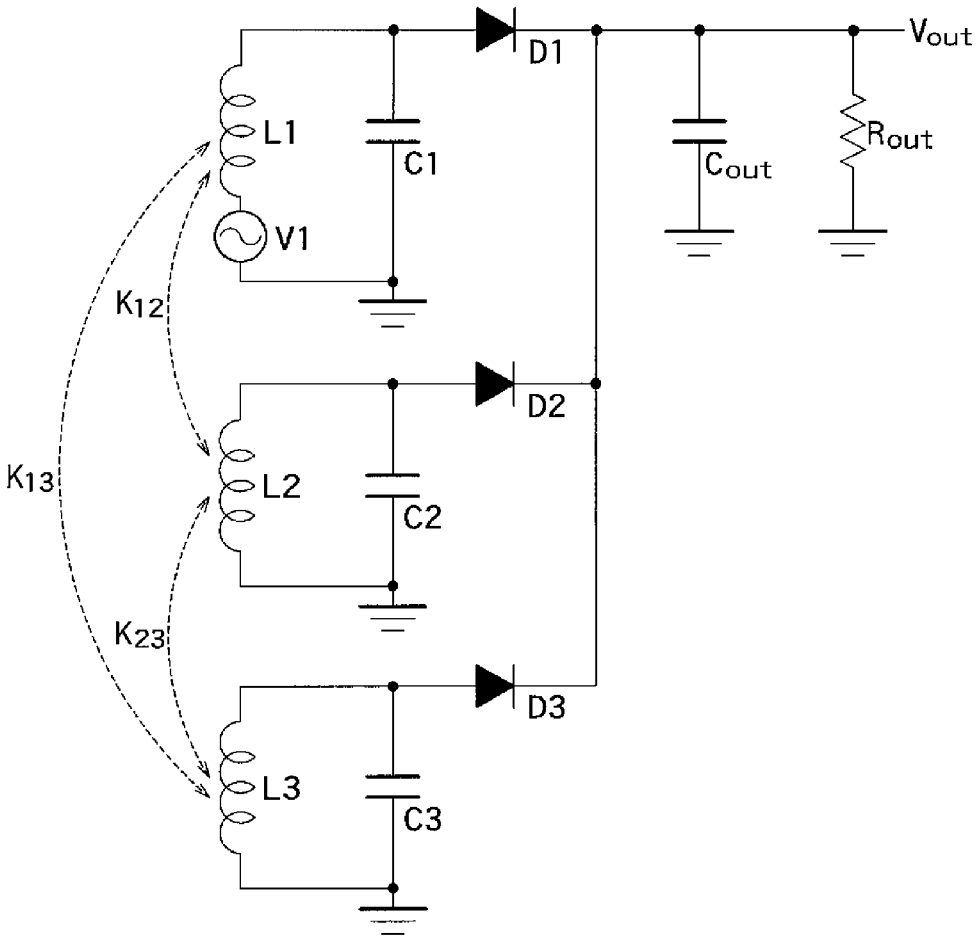
FIG. 10 is a circuit diagram explaining electro-magnetic coupling between the antenna coils of the three-axis antennas.

FIG. 10 shows a circuit configuration to simulate internal influences in the three-axis antenna when electro-magnetic coupling occurs among the antenna coils. The antenna coils L1, L2 and L3 are connected with resonant capacitors C1, C2 and C3 in parallel, respectively, and the outputs of the antenna coils L1, L2 and L3, connected in parallel to the capacitor Cout and the resistor Rout are connected, via the diodes D1, D2 and D3, to the terminal which outputs the voltage Vout. A voltage source V1, a voltage induced by an external magnetic field, is connected to the antenna coil L1.

Here, let us designate that the coupling coefficient between the antenna coils L1 and L2 as K12, the coupling coefficient between the antenna coils L2 and L3 as K23, and the coupling coefficient between the antenna coils L3 and L1 as K31.

Figure 11:
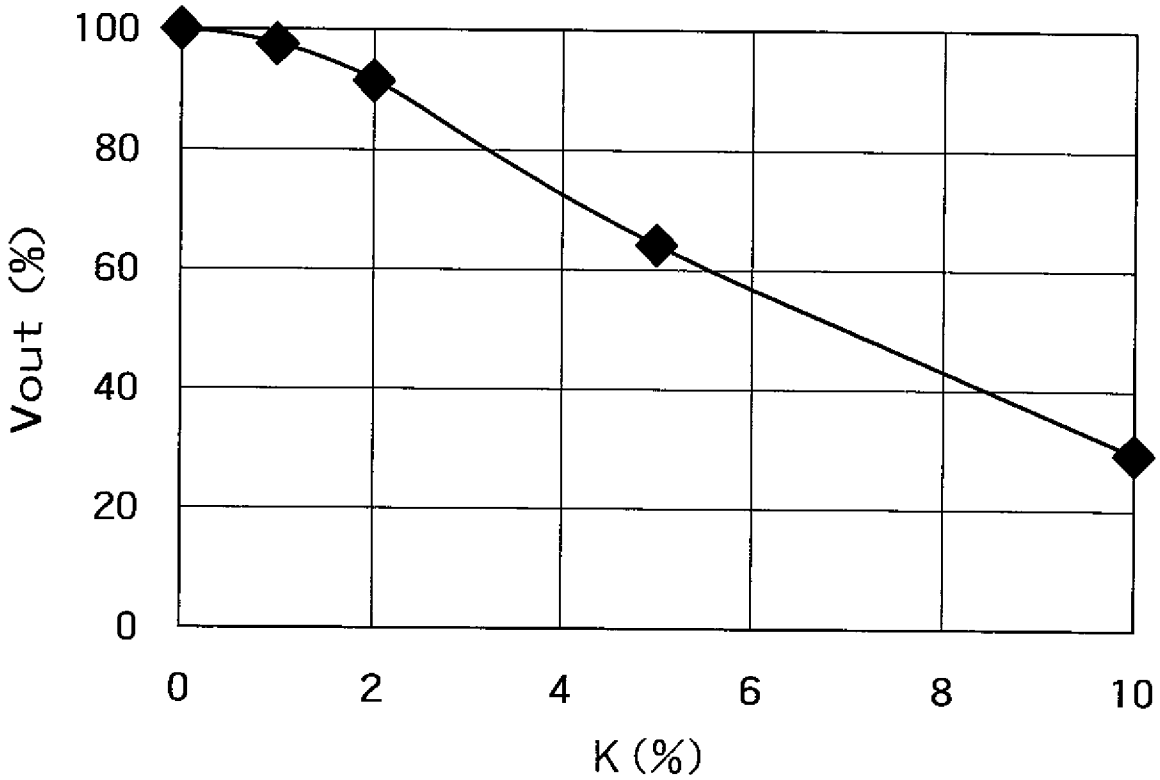
FIG. 11 is a graph showing the relationship between the coupling coefficient among the antenna coils of the three-axis antenna and the output voltage.

FIG. 11 is a graph showing the result of simulating the output voltage Vout when the coupling coefficient K varies from 0% to 10%, provided that K12=K23=K31=K. The abscissa represents the coupling coefficient K [%] and the ordinate represents the normalized output voltage Vout when the output voltage Vout is normalized as 100[%] and the coupling coefficient is zero.

As shown in FIG. 11, the output voltage Vout lowers 8% when the coupling coefficient K is 2%, and the output voltage Vout drops 71% when the coupling coefficient K is 10%.

In this manner, the electro-magnetic coupling between antenna coils deteriorates the reception sensitivity. Preferably, the coupling coefficient should be less than 2% and as close as possible to 0%.

Fourth Embodiment

Figure 12:
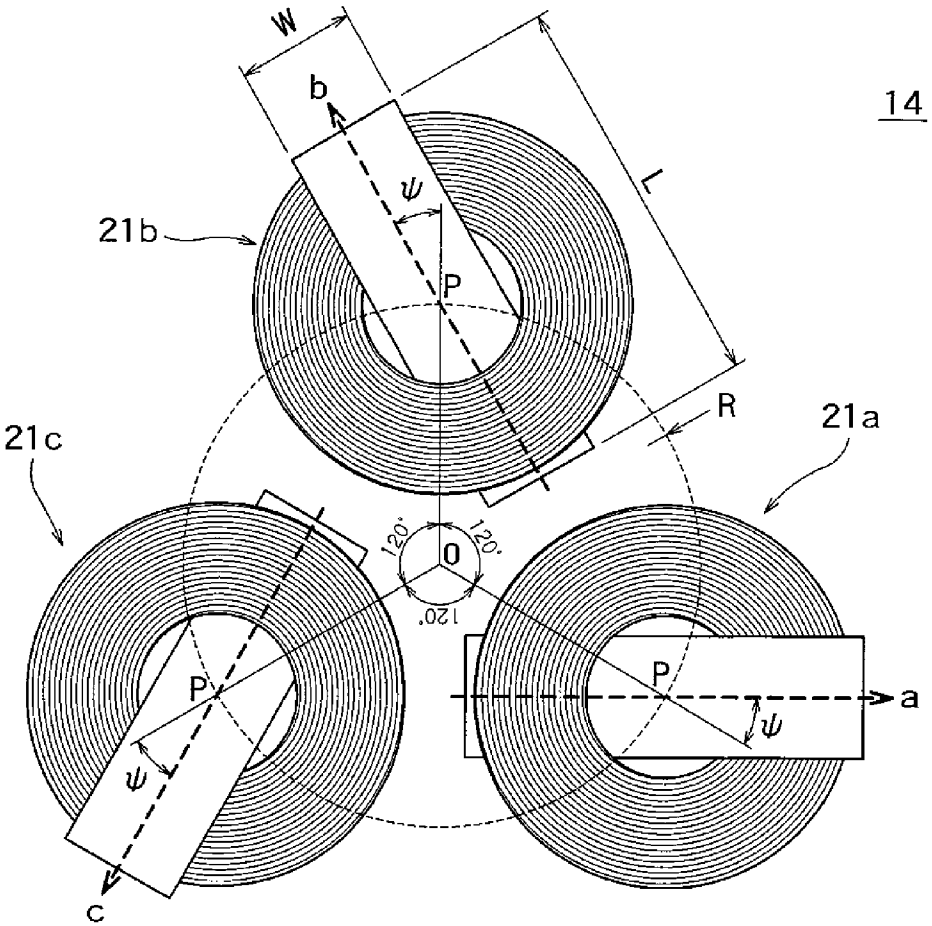
FIG. 12 is a plan view of the fourth embodiment of the present invention.

FIG. 12 is a plan view showing the fourth embodiment of the present invention. The fourth embodiment is mostly similar to the first embodiment, but is different therefrom in that the directions of the axes a, b and c of the sheet core 41 of the antenna coils 21*a*, 21*b* and 21*c* are rotated by the angle of ψ degrees around the centers P of the respective antenna coils.

As the three antenna coils 21*a*, 21*b* and 21*c* are rotated by y degrees in the same direction, the angles among the axes a, b and c are kept at 120°.

Figure 13:
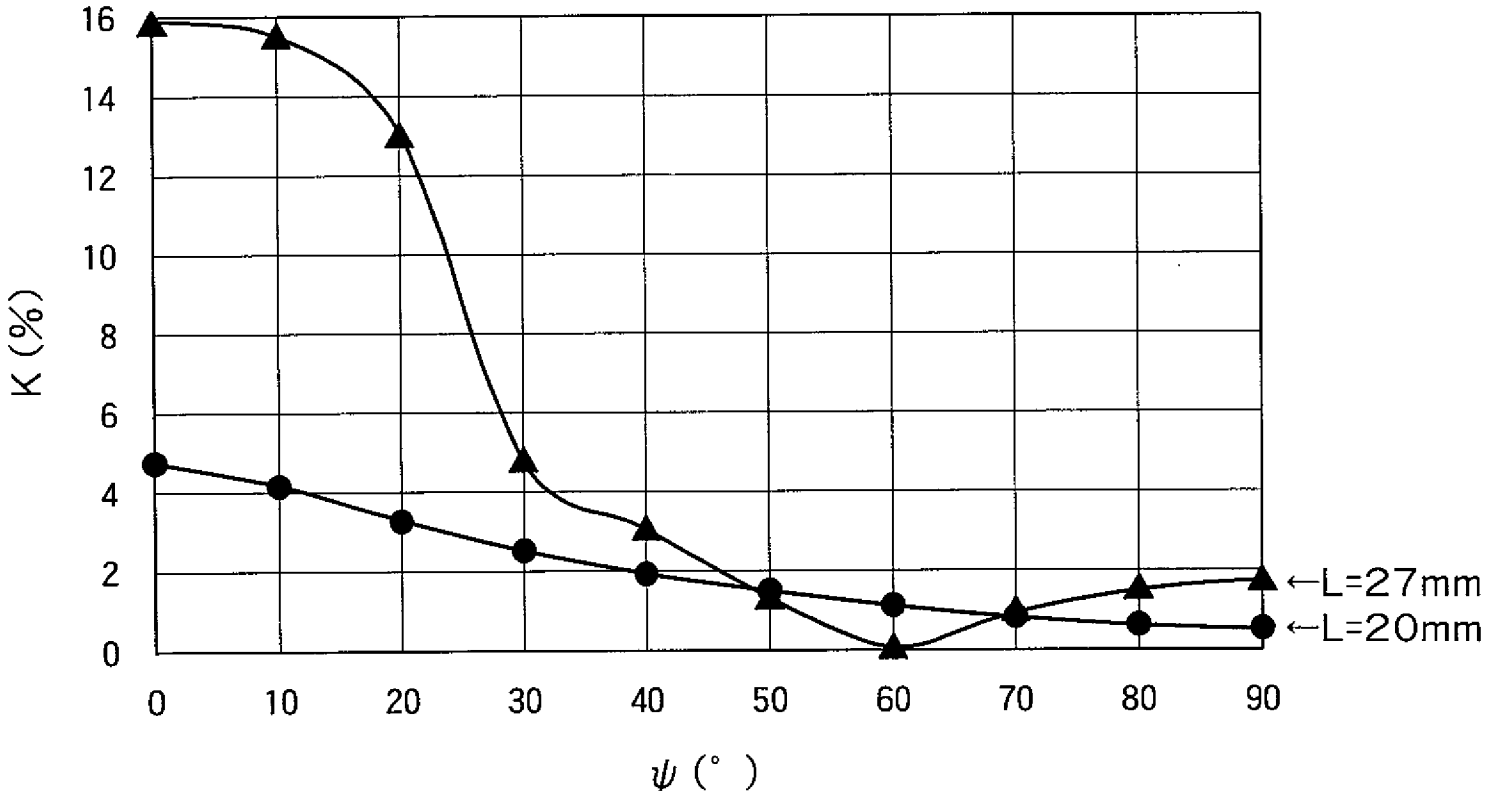
FIG. 13 is a graph showing the relationship between the rotation angle and the coupling coefficient of the three-axis antenna shown in FIG. 12.

FIG. 13 is a graph showing the coupling coefficient K among the antenna coils when the length L of the sheet core 41 is 20 mm or 27 mm and rotating an antenna coil by ψ (0°≤ψ≤90°), as in FIG. 12. In FIG. 13, the abscissa represents the angle of rotation ψ[°], and the ordinate represents the coupling coefficient K [%].

The radius is R=12 mm, and dimensions of the sheet core 41 are the width W=6 mm and the thickness $t_{41}$=0.060 mm.

From the results depicted in FIG. 13, it is understood that the coupling coefficient K among the antenna coils varies according to the rotation angle ψ, in the case the length L of the sheet core 41 is 20 mm, the coupling coefficient K is minimum at the rotation angle ψ=90°, and in the case that the length L of the sheet core 41 is 27 mm, the coupling coefficient K is nearly 0 at the rotation angle ψ=60°.

As the antenna coil has a shape symmetrical in relation to an axis orthogonal to the axial direction of the sheet core, in the graph of FIG. 13 the coupling coefficient K in the case that the rotation angle ψ>90° becomes symmetrical when ψ=90°.

Thus, the coupling coefficient K among antenna coils varies depending on the rotation angle ψ, the rotation angle ψ at which the coupling coefficient is minimized varies depending on the shape of the sheet core.

Fifth Embodiment

Figure 14:
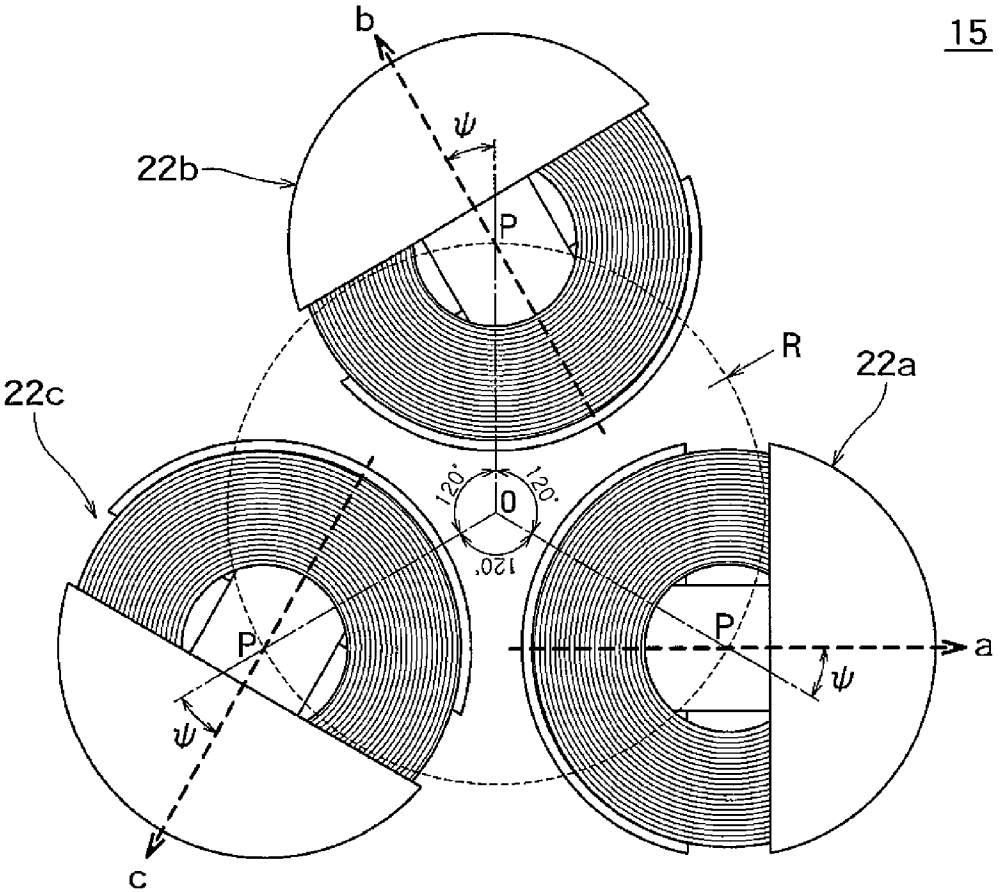
FIG. 14 is a plan view of the fifth embodiment of the present invention.

FIG. 14 is a plan view of the fifth embodiment of the present invention. The fifth embodiment is configured by applying the antenna coil 22 of the second embodiment to the antenna coils of the fourth embodiment. The antenna coils 22*a*, 22*b* and 22*c* are the same as the antenna coil 22 described in the second embodiment.

Figure 15:
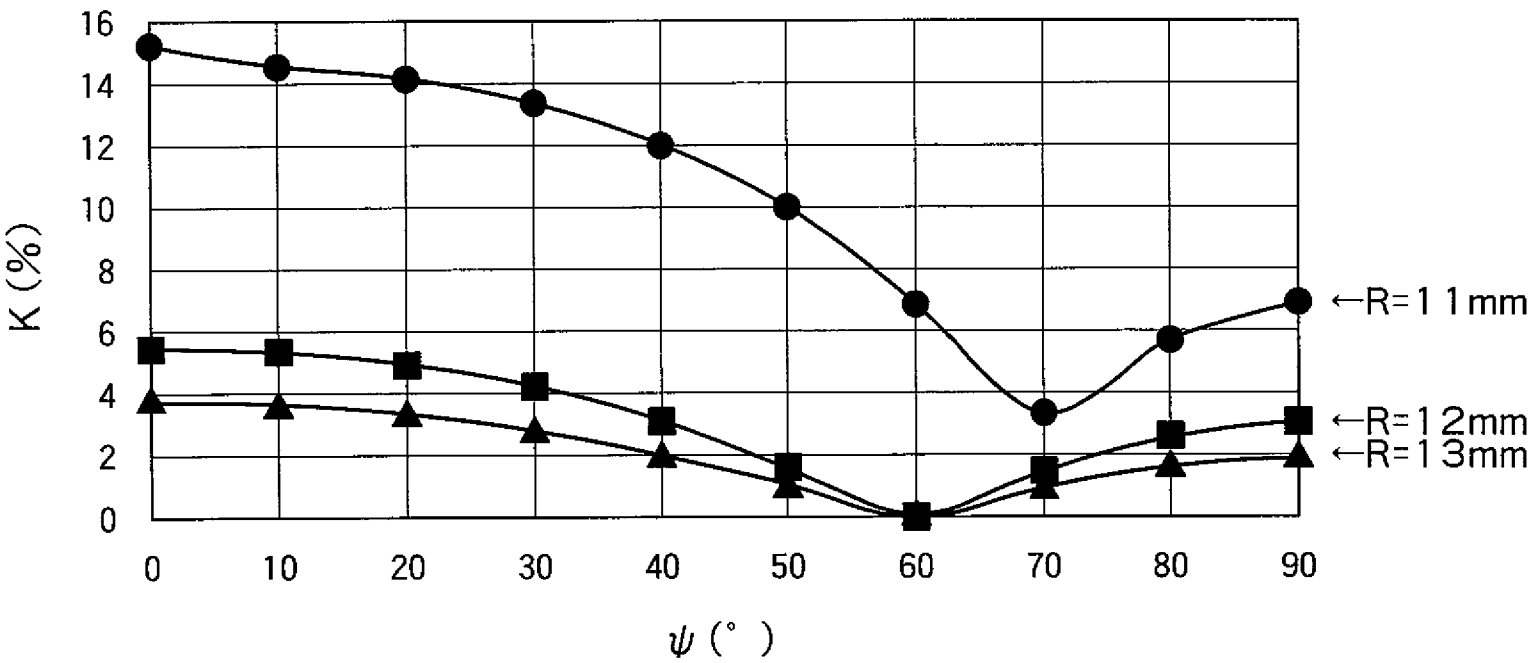
FIG. 15 is a graph showing the relationship between the rotation angle and the coupling coefficient of the three-axis antenna shown in FIG. 14.

FIG. 15 is a graph showing the coupling coefficient K among the antenna coils 22*a*, 22*b* and 22*c*, which are arranged on a circle of radius R=13 mm, 12 mm and 11 mm, being rotated around the center P of the respective antenna coils by the angle ψ (0°≤ψ≤90°) as shown in FIG. 14.

In FIG. 15, the abscissa represents the rotation angle ψ[°], and the ordinate represents the coupling coefficient K [%]. The antenna coils 22*a*, 22*b* and 22*c* are configured by the dimensions $W_{42a}$=6 mm, $L_{42a}$=20 mm, $W_{42b}$=8 mm and $t_{42}$=0.060 mm.

As shown in FIG. 15, the coupling coefficient K varies depending on the rotation angle ψ, and in the cases of R=12 mm and R=13 mm, the coupling coefficient K is nearly zero at the rotation angle ψ=60°, and in the case of radius R=11 mm, the coupling coefficient can be minimized at the rotation angle ψ=70°.

The reason the coupling coefficient does not become zero at radius R=11 mm is that the sheet cores of the antenna coils are overlapped each other.

As described above, not only the coupling coefficient K becomes smaller if radius R is increased, it also varies depending on the rotating angle ψ.

Sixth Embodiment

Figure 16:
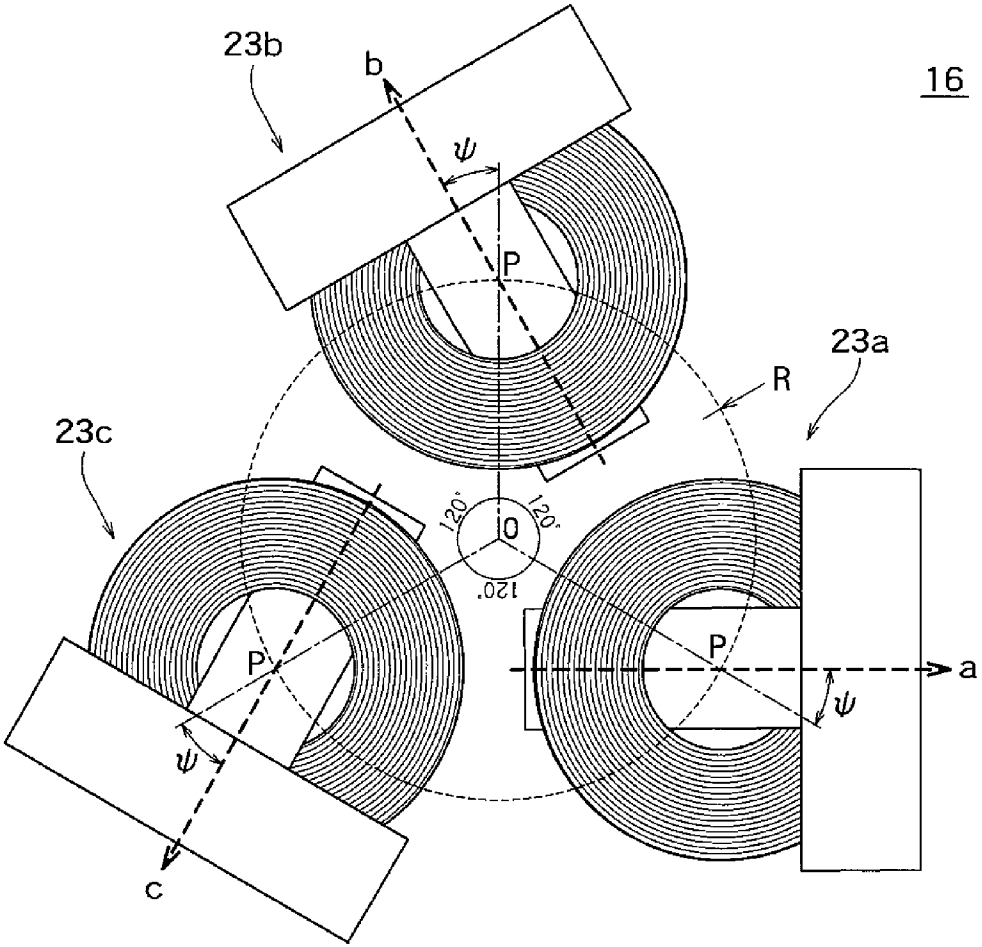
FIG. 16 is a plan view of the sixth embodiment of the present invention.

FIG. 16 is a plan view of the sixth embodiment of the present invention. The sixth embodiment is configured by applying the antenna coil 23 of the third embodiment to the antenna coils of the fourth embodiment. The antenna coils 23*a*, 23*b* and 23*c* are the same as the antenna coil 23 described in the third embodiment.

Figure 17:
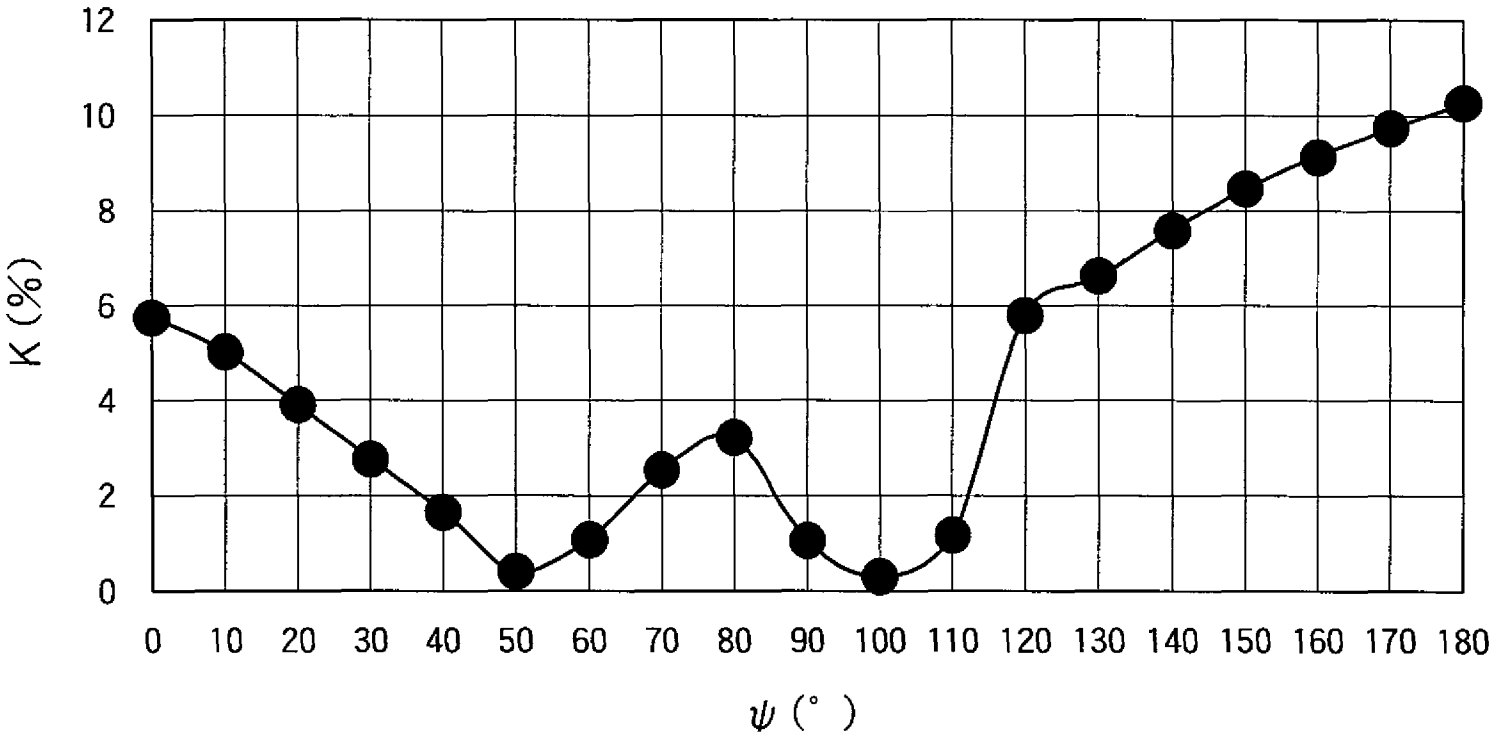
FIG. 17 is a graph showing the relationship between the rotation angle and the coupling coefficient of the three-axis antenna shown in FIG. 16.

FIG. 17 is a graph showing the coupling coefficient K among the antenna coils, which are rotated by the angle ψ (0°≤ψ≤180°) as shown in FIG. 16. In FIG. 17, the abscissa represents the rotation angle ψ[°], and the ordinate represents the coupling coefficient K [%]. Besides, the radius R=12 mm, and the antenna coils 23*a*, 23*b* and 23*c* have the dimensions of $W_{43a}$=6 mm, $L_{43a}$=20 mm, $W_{43b}$=8 mm, $L_{43b}$=20 mm and $t_{43}$=0.060 mm.

As shown in FIG. 17, the coupling coefficient K varies depending on the rotation angle ψ, and is nearly zero when the rotation angle is about 50° or 100°.

As described above, the coupling coefficient K varies depending on the rotation angle ψ which minimum value varies in relation to the shape of the sheet core. In addition, in the case the sheet core is not symmetrical in relation to an axis orthogonal to the axial direction of the sheet core, the graph of the coupling coefficient K is not symmetrical in relation to the rotation angle ψ=90° as shown in the graph of FIG. 13.

Seventh Embodiment

Figure 18:
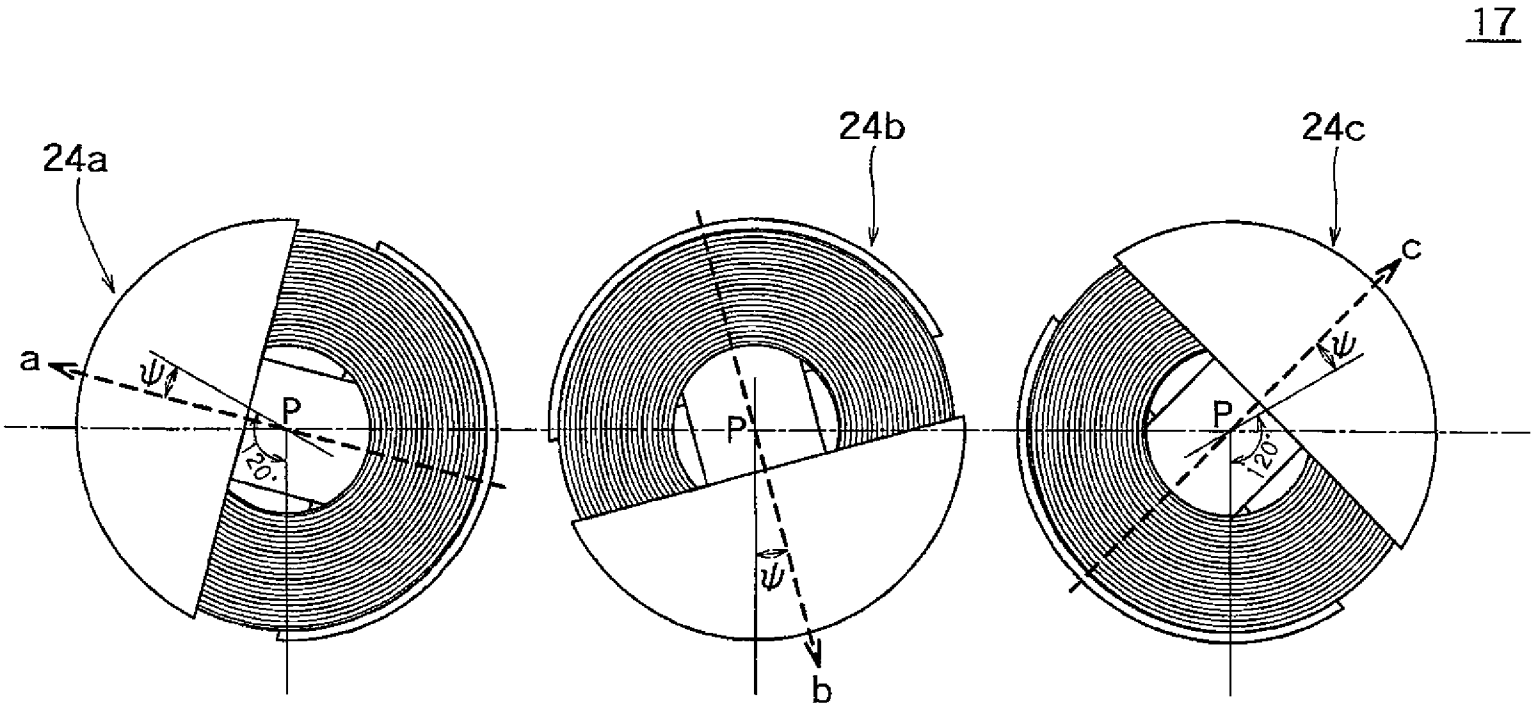
FIG. 18 is a plan view of the seventh embodiment of the present invention.

FIG. 18 is a plan view of the seventh embodiment of the present invention. The sixth embodiment is configured by applying the antenna coil 23 of the third embodiment to the antenna coils of the fourth embodiment. The antenna coils 24*a*, 24*b* and 24*c* are arranged so that the centers P of the antenna coils are collinear, and the a axis, the b axis and the c axis of the respective sheet cores form an angle of 120° between each other. The antenna coils 24*a*, 24*b* and 24*c* are the same as the antenna coil 22 described in the second embodiment.

Figure 19:
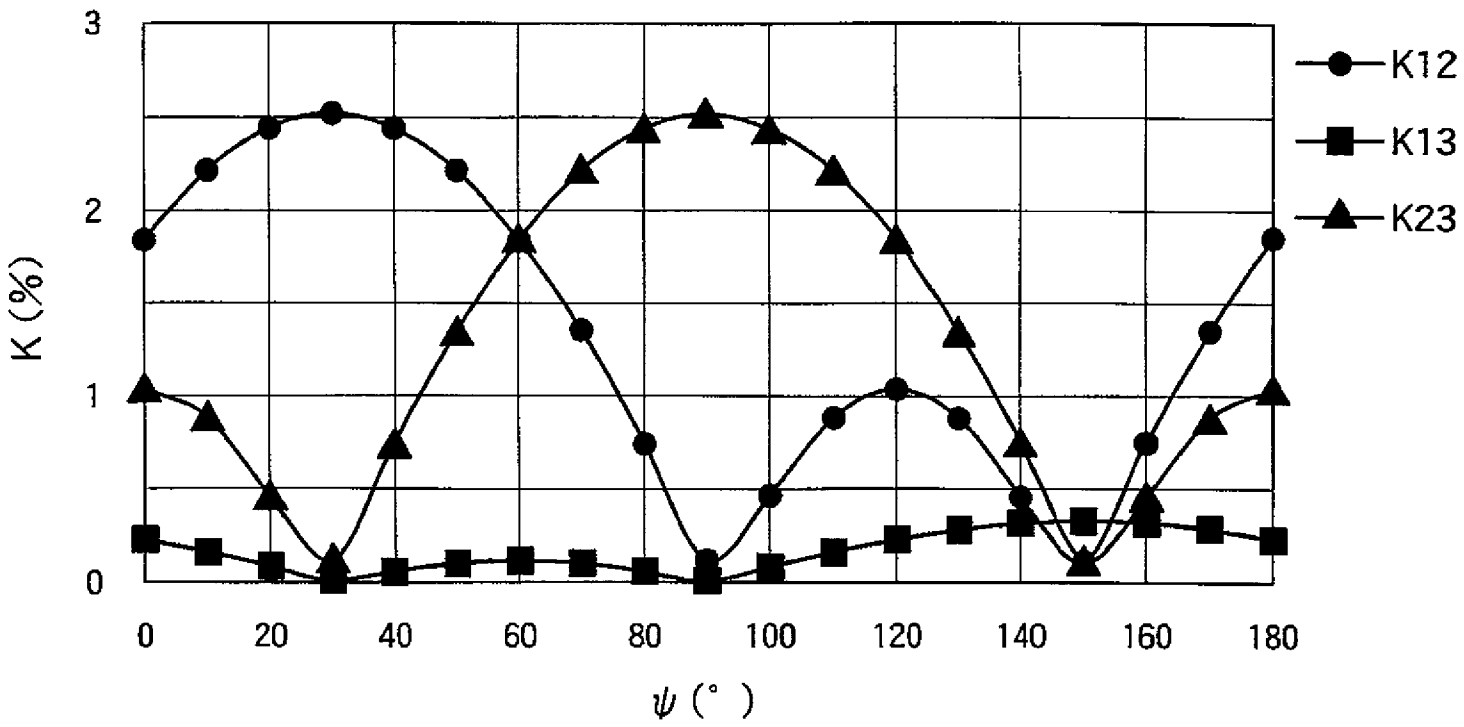
FIG. 19 is a graph showing the relationship between the rotation angle and the coupling coefficient of the three-axis antenna shown in FIG. 18.

FIG. 19 is a graph showing the coupling coefficient K between the respective antenna coils when rotated by an angle ψ (0°≤ψ≤180°). In FIG. 19, the abscissa represents the rotation angle ψ[°], and the ordinate represents the coupling coefficient K [%], the coupling coefficient between the antenna coil 24*a* and the antenna coil 24*b* is K12, the coupling coefficient between the antenna coil 24*b* and the antenna coil 24*c* is K23, and the coupling coefficient between the antenna coil 24*a* and the antenna coil 24*c* is K13.

As shown in FIG. 19, the coupling coefficient K varies depending on the rotation angle ψ. Note that, as shown in the fourth through sixth embodiments, the coupling coefficients of the antenna coils are not all the same, and they are different for each antenna coil. When the rotation angle ψ is about 150°, the coupling coefficients are K12=0.11, K23=0.32 and K31=0.12.

Thus, there is an optimal rotation angle ψ which minimizes the coupling coefficients between the antenna coils, regardless the arrangement of the antenna coils.

As described in the fourth through seventh embodiments, by adjusting the rotation angle while maintaining the angle of 120° between the axial directions of the respective antenna coils even if the antenna coils are positioned closely together, the coupling among the antenna coils can be minimized and a three-axis antenna of slightly decreased receiving sensitivity is obtained. As a result, a three-axis antenna which requires a smaller area is available. It is important that the respective antenna coils do not overlap each other.

Although the preferable embodiments of the present invention have been described above, the present invention should not be limited to the scope of the protection of the embodiments, and, needless to say, many modifications and alterations within the spirit of the present invention shall be covered by the scope of protection of the present invention.

For example, the material of the sheet core has been described as a softly magnetic thin film on PET base material, however, various materials, including ferrite in sheet or plate, form metallic magnetic resin impregnated with metallic magnetic powder, etc., are applicable to the present invention. As for the positioning of the antenna coils, without limiting to positions where the centers P are concentric or collinear, they can be freely arranged as long as the antenna coils do not overlap each other, including an arrangement where coplanar antenna coils are positioned on the top and bottom surfaces of a circuit board.

The present invention relates to a three-axis antenna suitable for incorporating in a thin article such as IC cards. However, without being limited to incorporating in IC cards, the present invention is applicable to transmission antennas or various antennas, without being limited to reception antennas.

EXPLANATION OF CODES

11, 14, 15, 16, 17, 70 three-axis antenna
21, 21*a*, 21*b*, 21*c*, 22, 22*a*, 22*b*, 22*c*, 23, 23*a*, 23*b*, 24*a*, 24*b*, 24*c* antenna coil
31, 32, 33 planar coil
41, 42, 43 sheet core
42*a*, 42*b*, 43*a*, 43*b* core piece
80 core
81, 82, 83 groove
91, 92, 93 coil
a, b, c core axis
R radius
L length
W width
t thickness
K coupling coefficient
ψ rotation angle

What is claimed is:

1. A three-axis antenna comprising a first antenna coil, a second antenna coil and a third antenna coil each of the antenna coils including a planar coil wound around a winding axis of the planar coil, and a sheet core made of a magnetic material and inserted into a central hole of the planar coil, wherein each sheet core and each planar coil overlap so that a lower surface at one end of the sheet core contacts an upper surface of the planar coil, and an upper surface at an opposite end of the sheet core contacts a lower surface of the planar coil, the antenna coils are arranged on a plane, each of the antenna coils has a reception sensitivity in one direction, an angle between the direction of each of the reception sensitivities and the plane is approximately 35.26°, the directions of the reception sensitivities are orthogonal to each other, the antenna coils are arranged in a manner that the respective antenna coils are spaced from each other, the planes of the planar coils are coplanar, and the axial direction of the respective sheet cores of the antenna coils cross and form an angle of 120° with each other, and the antenna coils are arranged in a manner that the antenna coils are rotated around the center thereof in a same direction and by a same degree so as to minimize mutual electro-magnetic coupling between each of the antenna coils.

2. The three-axis antenna claimed in claim 1, wherein the planar coils are arranged in a manner that the centers thereof are on the same circle.

3. The three-axis antenna claimed in claim 1, wherein the sheet cores have rectangular and I-shaped outlines.

4. The three-axis antenna claimed in claim 1, wherein the sheet cores are substantially H-shaped with outlines cut to fit the outlines of the planar coils.

5. The three-axis antenna claimed in claim 1, wherein the sheet cores have T-shaped outlines.

* * * * *